US008056343B2

(12) United States Patent
Hessler et al.

(10) Patent No.: US 8,056,343 B2
(45) Date of Patent: Nov. 15, 2011

(54) OFF CENTER COMBUSTOR LINER

(75) Inventors: Wiliam K. Hessler, Greer, SC (US); Tony Davis, Greenville, SC (US)

(73) Assignee: General Electric Company, Schenectady, NY (US)

( * ) Notice: Subject to any disclaimer, the term of this patent is extended or adjusted under 35 U.S.C. 154(b) by 570 days.

(21) Appl. No.: 12/243,122

(22) Filed: Oct. 1, 2008

(65) Prior Publication Data

US 2010/0077762 A1 Apr. 1, 2010

(51) Int. Cl.
*F02C 1/00* (2006.01)

(52) U.S. Cl. ..... 60/752; 60/804

(58) Field of Classification Search ..... 60/39.37, 60/737, 752, 754–760, 776, 804
See application file for complete search history.

(56) References Cited

U.S. PATENT DOCUMENTS

| | | | | | |
|---|---|---|---|---|---|
| 3,596,813 | A | | 8/1971 | Munn | |
| 3,608,309 | A | | 9/1971 | Hill et al. | |
| 3,807,464 | A | | 4/1974 | Pitesky | |
| 3,845,791 | A | | 11/1974 | Friendship | |
| 4,179,881 | A | * | 12/1979 | Faucher et al. | 60/737 |
| 4,271,674 | A | * | 6/1981 | Marshall et al. | 60/737 |
| 4,600,125 | A | | 7/1986 | Maynard, Jr. | |
| 4,653,278 | A | * | 3/1987 | Vinson et al. | 60/737 |
| 4,832,211 | A | | 5/1989 | Matthews et al. | |
| 4,845,940 | A | | 7/1989 | Beer | |
| 4,875,339 | A | | 10/1989 | Rasmussen et al. | |
| 5,165,226 | A | * | 11/1992 | Newton et al. | 60/804 |
| 5,211,308 | A | | 5/1993 | Decker et al. | |
| 5,253,478 | A | | 10/1993 | Thibault et al. | |
| 5,329,759 | A | * | 7/1994 | Chan | 60/776 |
| 5,465,570 | A | * | 11/1995 | Szillat et al. | 60/776 |
| 5,649,992 | A | | 7/1997 | Carter, Jr. et al. | |
| 5,891,207 | A | | 4/1999 | Katta | |
| 5,964,417 | A | | 10/1999 | Amann et al. | |
| 6,006,523 | A | * | 12/1999 | Mandai et al. | 60/722 |
| 6,029,838 | A | | 2/2000 | Hansen et al. | |
| 6,070,753 | A | | 6/2000 | Hirst et al. | |
| 6,250,063 | B1 | * | 6/2001 | Davis et al. | 60/773 |
| 6,279,313 | B1 | | 8/2001 | Lawen, Jr. et al. | |
| 6,311,471 | B1 | * | 11/2001 | Waldherr et al. | 60/775 |
| 6,334,297 | B1 | * | 1/2002 | Dailey et al. | 60/785 |
| 6,484,505 | B1 | | 11/2002 | Brown et al. | |
| 6,497,105 | B1 | * | 12/2002 | Stastny | 60/796 |
| 6,951,109 | B2 | | 10/2005 | Lemon et al. | |
| 6,983,606 | B2 | * | 1/2006 | Brown | 60/776 |
| 6,986,253 | B2 | * | 1/2006 | Leen et al. | 60/772 |
| 6,996,990 | B2 | | 2/2006 | Diinu | |

(Continued)

FOREIGN PATENT DOCUMENTS

EP 0318312 B1 5/1989

(Continued)

*Primary Examiner* — William Rodriguez
*Assistant Examiner* — Michael B Mantyla
(74) *Attorney, Agent, or Firm* — Suthrland Asbill & Brennan LLP

(57) ABSTRACT

The present application provides a liner for a combustor. The combustor liner may include a mouth, a passage for a flow of fuel, a passage for a flow of air, a first zone for mixing the flow of fuel and the flow of air, and the first zone having a constant diameter. The combustor liner may have at least one transition zone with first and second side walls angled substantially in the same direction, and an off center exit. This configuration will provide a more stable flow when exiting the combustor liner.

9 Claims, 2 Drawing Sheets

U.S. PATENT DOCUMENTS

| | | | | |
|---|---|---|---|---|
| 7,086,232 | B2 | 8/2006 | Moertle et al. | |
| 7,089,741 | B2 * | 8/2006 | Ikeda et al. | 60/725 |
| 7,090,205 | B2 * | 8/2006 | Oda et al. | 261/78.1 |
| 7,146,816 | B2 * | 12/2006 | Anderson et al. | 60/772 |
| 7,185,497 | B2 * | 3/2007 | Dudebout et al. | 60/776 |
| 7,373,778 | B2 | 5/2008 | Bunker et al. | |
| 2003/0041801 | A1 | 3/2003 | Hehmann | |
| 2004/0103665 | A1 * | 6/2004 | Farmer et al. | 60/752 |
| 2005/0044842 | A1 | 3/2005 | Dinu | |
| 2005/0056313 | A1 | 3/2005 | Hagen et al. | |
| 2005/0112606 | A1 | 5/2005 | Fuchs et al. | |
| 2005/0263210 | A1 | 12/2005 | Najafi | |
| 2005/0268615 | A1 | 12/2005 | Bunker et al. | |
| 2005/0268617 | A1 | 12/2005 | Amond, III et al. | |
| 2006/0021674 | A1 | 2/2006 | Salani et al. | |
| 2006/0080966 | A1 | 4/2006 | Widener | |
| 2006/0096909 | A1 | 5/2006 | Patch | |
| 2006/0113112 | A1 | 6/2006 | Waters | |
| 2006/0191268 | A1 | 8/2006 | Widener et al. | |
| 2007/0089425 | A1 | 4/2007 | Motter et al. | |
| 2007/0144178 | A1 * | 6/2007 | Burd et al. | 60/753 |
| 2007/0157621 | A1 | 7/2007 | Koshoffer et al. | |

FOREIGN PATENT DOCUMENTS

| | | | |
|---|---|---|---|
| EP | 0486226 | A1 | 5/1993 |
| EP | 0492864 | A1 | 7/1993 |
| EP | 0550218 | B1 | 7/1993 |
| EP | 1130321 | A1 | 9/2001 |
| EP | 1363076 | A2 | 11/2003 |
| EP | 1806495 | A2 | 7/2007 |
| EP | 1852655 | A2 | 11/2007 |

* cited by examiner

OFF CENTER COMBUSTOR LINER

TECHNICAL FIELD

The present application relates generally to gas turbine engines and more particularly relates to a combustor liner or other type of passage with an off center throat and exit.

BACKGROUND OF THE INVENTION

Modern gas turbine engines generally must operate under strict emissions guidelines, particularly with respect to nitrogen oxides ($NO_x$). As such, gas turbine engine design must operate at high efficiency without producing undesirable air emissions. Many modern gas turbine engines thus use a very lean, premixed flame for low $NO_x$ combustion.

One way to limit turbine emissions is to ensure good mixing of the fuel and the air in the combustor. Proper mixing may involve mixing flow manipulation using dilution tuning or similar methods. Tuning a combustor in the field, however, may be difficult and time consuming. Moreover, the need to tune properly a combustor also may influence the time required for initial commissioning and/or cause other types of delays.

There is thus a desire for an improved combustor and other types of turbine components that promote good mixing of both fuel and air while providing high overall efficiency with limited emissions. Preferably the combustor or the other components may be used with new and existing equipment.

SUMMARY OF THE INVENTION

The present application thus provides for a liner for a combustor. The combustor liner may include a mouth, one or more angled transition zones, and an off center exit.

The present application also provides for a method of mixing fuel and air in a combustor. The method may include the steps of flowing the fuel and the air into a combustor liner, flowing the fuel and the air through one or more angled transition zones, and flowing the fuel and the air through an off center throat.

The present application also provides for a gas turbine. The gas turbine may include a passage for a flow of fuel, a passage for a flow of air, a first zone for mixing the flow of fuel and the flow of air, one or more angled transition zones down stream of the first zone, and an off center exit down stream of the one or more angled transition zones.

These and other features of the present application will become apparent to one of ordinary skill in the art upon review of the following detailed description when taken in conjunction with the several drawings and the appended claims.

DETAILED DESCRIPTION

Figure 1:
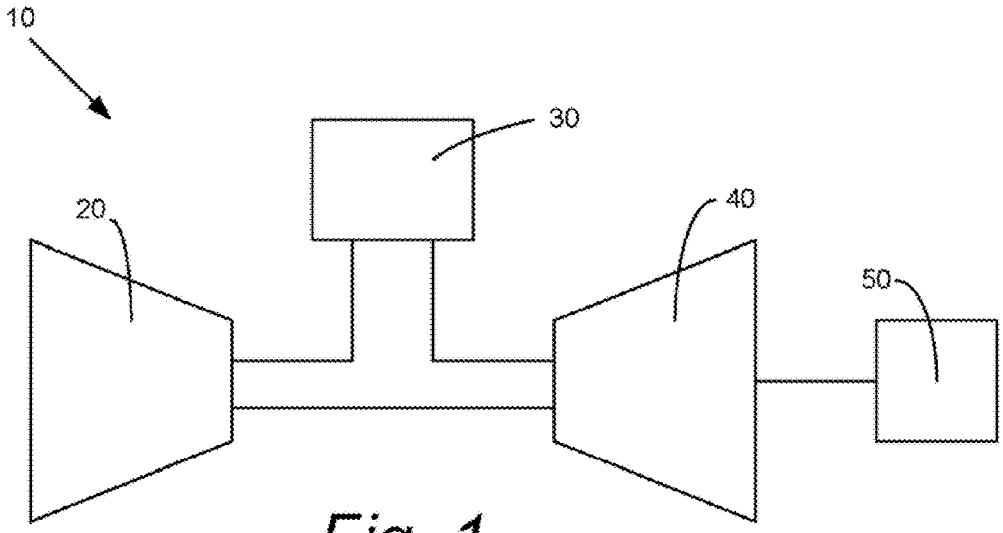
FIG. 1 is a schematic view of a gas turbine engine.

Referring now to the drawings, in which like numbers refer to like elements throughout the several views. FIG. 1 shows a schematic view of a gas turbine engine 10. As is known, the gas turbine engine 10 may include a compressor 20 to compress an incoming flow of air. The compressor 20 delivers the compressed flow of air to the combustor 30. The combustor 30 mixes the compressed flow of air with a flow of fuel and ignites the mixture. The hot combustion gases are in turn delivered to a turbine 40. The turbine 40 drives the compressor 20 and an external load 50 such as an electrical generator and the like. The gas turbine engine 10 may use other configurations and components herein.

Figure 2:
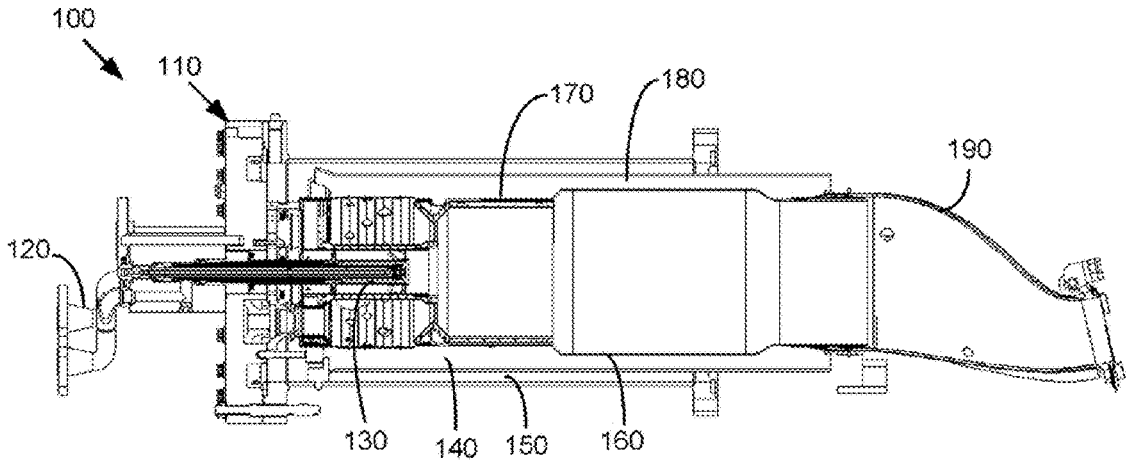
FIG. 2 is a side cross-section view of a combustor that may be used with the gas turbine engine of FIG. 1.

FIG. 2 shows an example of a combustor 100 as may be used herein. In this example, the combustor 100 may be a Model 6B or Model 7EA of the DLN-1 (Dry Low $NO_x$) Combustor System offered by General Electric Company of Schenectady, N.Y. The concepts described herein, however, may be applicable to any type of combustor and also to many other types of turbine related components and other types of pathways.

Generally described, the combustor 100 may include an end cover assembly 110. The end cover assembly 110 may include a number of fuel manifolds 120. The fuel manifolds 120 may be in communication with a fuel nozzle assembly 130. The fuel nozzle assembly 130 may support both diffusion and premixed combustion. Compressed air may be delivered to the combustor 100 by the compressor 20 via an air passage 140. The air passage 140 may be defined by a combustor flow sleeve 150 and a combustor liner 160. Many other designs and turbine configurations also may be used herein.

The fuel flows and the air flows may meet about the fuel nozzle assembly 130 and may be ignited within the combustion liner 160. The combustor liner 160 may include a mixing zone 170 and a combustion zone 180. The combustor liner 160 extends into a transition piece 190 that is adjacent to the turbine 40. As is shown, the existing combustor liner designs 160 are essentially concentric in shape with a horizontal centerline extending uniformly therethrough. At least a portion of the flow path, however, comes into contact with the curved transition piece 190. This concentric shape of the liner 160, when combined with the curve of the transition piece 190, thus may create a somewhat restrictive flow path therethrough.

Figure 3:
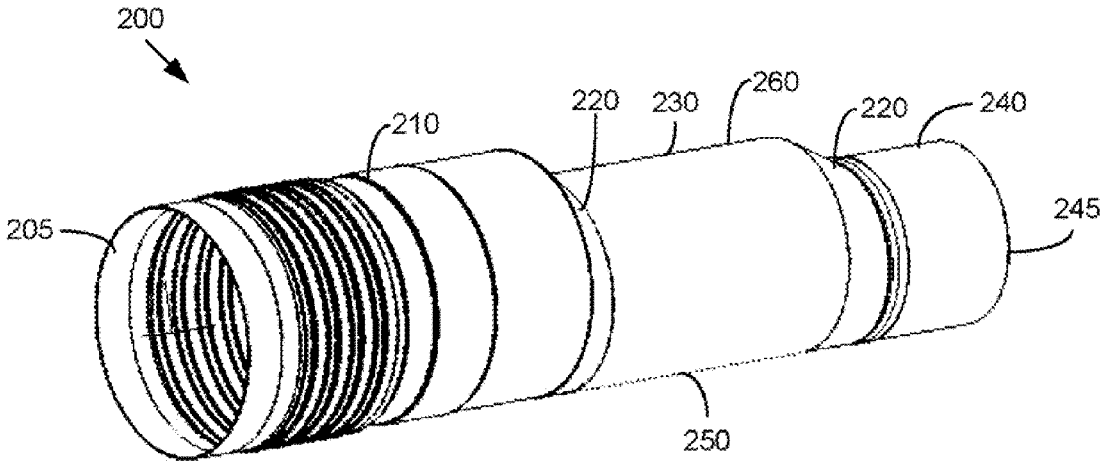
FIG. 3 is a perspective view of a combustor liner as may be described herein.

FIG. 3 shows a combustor liner 200 as may be described herein. Instead of the combustion liner 160 with the mixing zone 170 and the combustion zone 180 merging into the transition piece 190 as is described above, the combustion liner 200 may be a unified element. The combustor liner 200 may include a mouth 205, a combustion zone 210, a number of angled transition zones 220, at least one straight transition zone 230, and an off center throat 240 with an off center exit 245. As is shown, the combustor liner 200 has an essentially flat first side 250 and with the angle transitions zones 220 positioned about a stepped second side 260. As a result of this shape, the flow path through the liner 200 is off center as compared to the entrance of the mouth 205. Although the flow path takes a small dip in each of the angled transition zones 220, the flow path is actually less restrictive therethrough. Any number of angled transition zones 220 may be used.

The off center throat 240 and the exit 245 of the liner 200 thus provides a shape similar to that of a Forstman funnel concept. A Forstman funnel is a funnel with the exit mouth being off center from the inlet. Liquid flowing through a funnel tends to swirl and form a whirlpool. As a result, centrifugal forces move the liquid away from the drain hole thus reducing the funnel capacity. The asymmetric shape of the Forstman funnel, however, reduces the rotation speed of the liquid in the whirlpool such that the funnel capacity may be increased. Such a design may flow about fifty percent (50%) to about seventy percent (70%) more than a conventional funnel.

Applying this concept to a combustor 100, the design provides a more stable flow exiting the combustor 100 as compared to conventional cylindrically shaped components. Increased flow through the combustor 100 thus may allow for more complete airflow mixing. Likewise, the combustion zone 210 is lengthened by eliminating the curved transition piece 190. Improved mixing thus should result. More uniform flow and better mixing also should promote more complete combustion and hence lower emissions. Likewise, more even exhaust temperatures should result. The design should increase flow, cooling, and/or the exhaust profile by making the flow path therethrough less restrictive.

Figure 4:
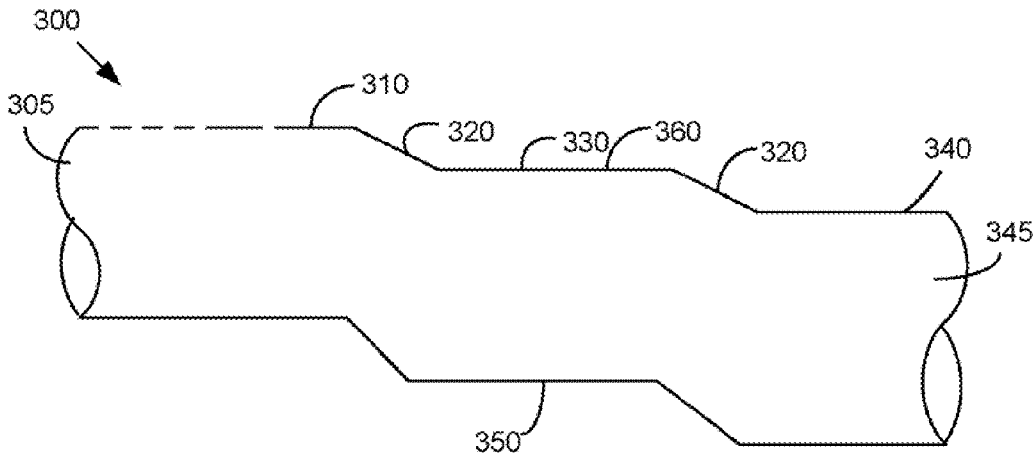
FIG. 4 is a perspective view of an alternative combustor liner as may be described herein.

FIG. 4 shows an alternative embodiment of a combustor liner 300 as is described herein. As described above, the combustor liner 300 includes a mouth 305, a combustion zone 310, a number of angled transition zones 320, one or more straight transition zones 330, and an off center throat 340 with an off center exit 345. In this embodiment, however, instead of the flat first side 250, the combustor liner 300 includes a stepped first side 350 that matches a stepped second side 360. As a result, the flow path therethrough is even more off center as compared to the combustor liner 200 described above.

Although the Forstman funnel concept described herein has focused on the combustor liners 200, 300, the concept also could be applied to flow sleeves, combustion cases, liner cap assemblies, secondary and primary fuel nozzles, fuel nozzle tips, end cover primary fuel nozzles, and in any place that flow goes through a staggered hole or is necked down.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A gas turbine, comprising:

a passage for a flow of fuel;

a passage for a flow of air;

a first zone for mixing the flow of fuel and the flow of air; the first zone having a constant diameter;

at least one angled transition zones down stream of the first zone; and an off center exit down stream of the at least one angled transition zones; wherein the at least one angled transition zones being connected to the first zone by a first stepped side and a second stepped side; wherein the first stepped side and the second stepped side are angled substantially in the same direction.

2. The gas turbine of claim 1, wherein the first zone comprises a combustion zone.

3. The gas turbine of claim 1, further comprising one or more straight transition zones.

4. The gas turbine of claim 1, further comprising an off center throat positioned about the off center exit.

5. The gas turbine of claim 4, wherein the off center exit and the off center throat comprise a Forstman funnel.

6. The gas turbine of claim 1, further comprising one or more transition zones and an off center throat and wherein the first zone, the one or more transition zones, and the off center throat comprise a flat first side extending from the mouth to the off center exit.

7. The gas turbine of claim 6, wherein the first zone, the one or more transition zones, and the off center throat comprise a stepped second side extending from the mouth to the off center exit.

8. The gas turbine of claim 1, further comprising one or more transition zones and an off center throat and wherein the first zone, the one or more transition zones, and the off center throat comprise a stepped first side extending from the mouth to the off center exit.

9. The gas turbine of claim 8, wherein the first zone, the one or more transition zones, and the off center throat comprise a stepped second side extending from the mouth to the off center exit.

* * * * *